US008552282B1

(12) United States Patent
Garcia et al.

(10) Patent No.: US 8,552,282 B1
(45) Date of Patent: Oct. 8, 2013

(54) PROPULSION DEFEATING SYSTEM

(75) Inventors: Felipe A. Garcia, Panama City, FL (US); Gregory A. Reitmeyer, Panama City, FL (US); Robert C. Woodall, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 284 days.

(21) Appl. No.: 13/066,231

(22) Filed: Apr. 11, 2011

(51) Int. Cl.
*F42B 19/01* (2006.01)

(52) U.S. Cl.
USPC ..... 114/23; 114/21.2; 89/1.13; 89/1.14; 89/1.34; 89/1.11

(58) Field of Classification Search
USPC ..... 114/21.3, 23, 21.2; 89/1.13, 1.14, 1.34, 89/1.11
See application file for complete search history.

(56) References Cited

U.S. PATENT DOCUMENTS

| | | | | | |
|---|---|---|---|---|---|
| 2,409,632 | A * | 10/1946 | King | 114/23 |
| 4,192,245 | A * | 3/1980 | Kendig et al. | 114/23 |
| 4,270,479 | A * | 6/1981 | Baker et al. | 114/240 A |
| 4,993,344 | A * | 2/1991 | Jones | 114/240 R |
| 5,267,220 | A * | 11/1993 | Burt | 367/131 |
| 5,675,116 | A * | 10/1997 | Hillenbrand | 114/21.2 |
| 5,675,117 | A * | 10/1997 | Hillenbrand | 114/21.2 |
| 5,686,694 | A * | 11/1997 | Hillenbrand et al. | 114/21.2 |
| 5,690,041 | A * | 11/1997 | Hillenbrand et al. | 114/21.2 |
| 5,794,533 | A * | 8/1998 | Takai | 104/73 |
| 6,325,015 | B1 * | 12/2001 | Garcia et al. | 114/382 |
| 6,883,452 | B1 * | 4/2005 | Gieseke | 114/244 |
| 6,923,105 | B1 * | 8/2005 | Gieseke et al. | 89/1.13 |
| 6,934,217 | B2 * | 8/2005 | Dutton et al. | 367/1 |
| 7,441,511 | B2 * | 10/2008 | Farinella et al. | 114/382 |
| 7,469,652 | B2 * | 12/2008 | Kristiansen et al. | 114/245 |
| 7,856,928 | B1 * | 12/2010 | Paulic | 102/402 |
| 7,882,775 | B2 * | 2/2011 | Martinez et al. | 89/1.34 |
| 8,046,947 | B2 * | 11/2011 | Fu et al. | 42/1.14 |
| 8,047,135 | B1 * | 11/2011 | Paulic et al. | 102/216 |
| 8,069,800 | B2 * | 12/2011 | Philippe et al. | 114/15 |
| 8,245,617 | B2 * | 8/2012 | Martinez et al. | 89/1.34 |
| 8,256,336 | B2 * | 9/2012 | Larkin et al. | 89/1.11 |
| 8,402,894 | B1 * | 3/2013 | McGuigan | 102/374 |
| 2002/0129694 | A1 * | 9/2002 | Hickey | 89/1.13 |
| 2004/0069134 | A1 * | 4/2004 | Sabates et al. | 89/1.14 |
| 2004/0200343 | A1 * | 10/2004 | Bell | 89/1.14 |
| 2005/0016372 | A1 * | 1/2005 | Kilvert | 89/1.34 |
| 2008/0216727 | A1 * | 9/2008 | Philippe et al. | 114/15 |
| 2008/0250998 | A1 * | 10/2008 | Bruengger et al. | 114/244 |
| 2009/0038530 | A1 * | 2/2009 | Truong et al. | 114/382 |
| 2009/0090286 | A1 * | 4/2009 | Korolenko et al. | 114/5 |
| 2009/0211509 | A1 * | 8/2009 | Olivier et al. | 114/244 |
| 2010/0269675 | A1 * | 10/2010 | Larkin et al. | 89/1.11 |
| 2010/0300346 | A1 * | 12/2010 | Gayton | 114/382 |
| 2011/0005374 | A1 * | 1/2011 | Martinez et al. | 89/1.34 |
| 2012/0037059 | A1 * | 2/2012 | Brenner | 114/21.2 |
| 2013/0125741 | A1 * | 5/2013 | Lambertus | 89/1.13 |

* cited by examiner

*Primary Examiner* — Michelle Clement
(74) *Attorney, Agent, or Firm* — James T. Shepherd

(57) ABSTRACT

A system for reducing the operational efficiency of a watercraft's propulsion system includes a self-propelled and variable-speed unmanned underwater vehicle (UUV) that has at least one homing device adapted to direct the UUV towards an origin of a targeted watercraft's propulsion wake. At least one rod is coupled to a forward end of the UUV and extends forward therefrom at least when the UUV is in proximity to the origin of the targeted watercraft's propulsion wake. At this point, the UUV is directed and accelerated to drive the rod into the targeted watercraft's propulsor.

17 Claims, 2 Drawing Sheets

PROPULSION DEFEATING SYSTEM

ORIGIN OF THE INVENTION

The invention described herein may be manufactured and used by or for the Government of the United States of America for Governmental purposes without payment of any royalties thereon or therefore.

FIELD OF THE INVENTION

The invention relates generally to underwater defense systems, and more particularly to an underwater system for reducing the operational efficiency of a watercraft's propulsion system.

BACKGROUND OF THE INVENTION

Ongoing efforts to prevent terrorist attacks on ports and vessels in port (or catch fleeing pirates/smugglers for intelligence purposes such as recruitment) include a variety of non-lethal schemes to slow or stop the process of a suspicious watercraft before it gets close to an asset or escapes. Presently, such non-lethal schemes are a variety of propeller entanglement devices/systems (e.g., lines, nets, etc.) or devices/systems designed to slow the speed of a suspicious watercraft (e.g., nets positioned to snare the watercraft's bow, drogue chutes attached to the watercraft, etc.). However, these schemes are only marginally effective against propellers and are difficult to move into position when the suspicious watercraft is highly maneuverable thereby making them tactically and operationally unsuitable. In addition, these schemes are ineffective against jet-drive systems which are devoid of propellers.

SUMMARY OF THE INVENTION

Accordingly, it is an object of the present invention to provide a system for slowing or stopping a suspicious watercraft.

Another object of the present invention is to provide a non-lethal system that can effectively slow or stop the progress of a highly maneuverable watercraft.

Other objects and advantages of the present invention will become more obvious hereinafter in the specification and drawings.

In accordance with the present invention, a system is provided for reducing the operational efficiency of a watercraft's propulsion system. The system includes a self-propelled and variable-speed unmanned underwater vehicle (UUV) that has at least one homing device adapted to direct the UUV towards an origin of a targeted watercraft's propulsion wake. At least one rod is coupled to a forward end of the UUV and extends forward therefrom at least when the UUV is in proximity to the origin of the targeted watercraft's propulsion wake. At this point, the UUV is directed and accelerated to drive the rod into the targeted watercraft's propulsor.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
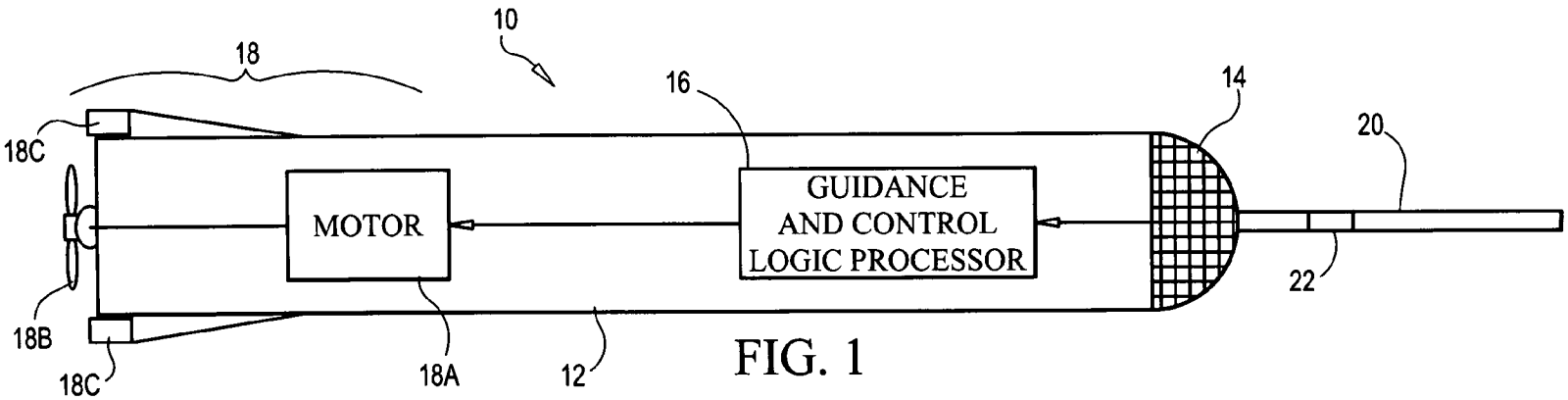
FIG. 1 is a side schematic view of a system for reducing the operational efficiency of a watercraft's propulsion system in accordance with an embodiment of the present invention.

Referring now to the drawings and more particularly to FIG. 1, a system for reducing the operational efficiency of a watercraft's propulsion system is shown and is referenced generally by numeral 10. The "watercraft" (not shown) referred to herein is assumed to be operating on the surface of a body of water in a manner that is, at the very least, suspicious in nature. System 10 is designed to track or target this watercraft and then slow or halt the targeted watercraft in a non-lethal manner via a reduction in the operational efficiency of the watercraft's propulsion system.

System 10 includes an unmanned underwater vehicle (UUV) 12 that is capable of self-propulsion through the water and capable of both speed and directional variation. For example, UUV 12 can be a torpedo equipped with both propulsion and guidance/homing features. Since a variety of such torpedoes are known in the art, details of propulsion and guidance/homing features will not be described herein and are not limitations of the present invention.

UUV 12 will typically have a transducer array 14 at its forward end with the outputs thereof being supplied to an onboard guidance and control logic processor 16. Array 14 could also be a side-scan type transducer array without departing from the scope of the present invention. Guidance and control logic outputs will typically be provided to an onboard propulsion system 18 that includes, for example, a motor 18A, a propeller 18B (or impellor) and control surfaces 18C. The type of motor 18A (e.g., internal combustion, electric, gas generator, etc.) and fuel used thereby are not limitations of the present invention. Array 14 and the guidance/control logic employed by processor 16 can be realized by a variety of designs/schemes without departing from the scope of the present invention. For example a variety of acoustic transducers and/or wake detecting transducers can be used to construct array 14. The guidance/control logic used by processor 16 can include various acoustic tracking and/or wake tracking schemes that will guide UUV 12 to the source or origin of a targeted watercraft's wake, i.e., the targeted watercraft's propulsor. By way of example, one such wake tracking scheme is described in U.S. Pat. No. 4,192,245.

Fixedly mounted to the forward end of UUV 12 is a ramming rod 20 that can be fabricated from any of a variety of strong metals or alloys thereof (e.g., 316 stainless steel, 6061-T6 aluminum, etc.), or a composite material that is corrosion resistant in a marine environment. Rod 20 extends forward of UUV 12. While the particular length of rod 20 is not a limitation of the present invention, it will typically be approximately 2-4 feet in length for reasons that will be described further below. Rod 20 can incorporate one or more weakened regions 22 at a position(s) along its length that is forward of UUV 12. A weakened region 22 can be realized by scoring, notching, necking, etc., such that rod 20 will break at region 22 when a force (e.g., bending force, twisting force, or combinations thereof) is applied to rod 20.

In operation, UUV 12 is launched from a platform (e.g., submarine, surface ship, stationary depot, etc.) when a suspicious or fleeing watercraft is to be targeted. The combination of array 14, processor 16 and propulsion system 18 cooperate to guide UUV 12 to the origin of the targeted watercraft's wake in any one of a variety of ways well known in the art. In general, UUV 12 will be maneuvered to a location just aft of the targeted watercraft's propulsor (not shown). At this point, UUV 12 enters a terminal guidance phase that essentially steers and accelerates UUV 12 such that rod 20 is driven into the targeted watercraft's propulsor (e.g., propeller or impellor). Terminal guidance can utilize just the outputs generated by array 14 and/or supplemental target information as will be explained further below.

Non-lethal damage is quickly inflicted by the ramming of rod 20 into the targeted watercraft's propulsor. If rod 20 does not incorporate a weakened region 22, the strike force applied by the momentum of UUV 12 should be sufficient to inflict damage to the propulsion system. However, if rod 20 includes weakened region 22, the forces acting on rod 20 by the propeller/impeller will cause rod 20 to break off forward of UUV 12 whereby rod 12 is then free to become entangled in the targeted watercraft's propeller/impeller. The insertion of rod 20 in the targeted watercraft's propulsor and/or its entanglement therein will immediately reduce/defeat the operational efficiency of the targeted watercraft's propulsion system to thereby avert an attack or thwart an escape. Thus, the effectiveness of the targeted watercraft is defeated without sinking it. At the same time, since rod 20 extends forward of UUV 12 and can readily break free therefrom, UUV 12 remains undamaged so that it can be retrieved for further use.

Figure 2:
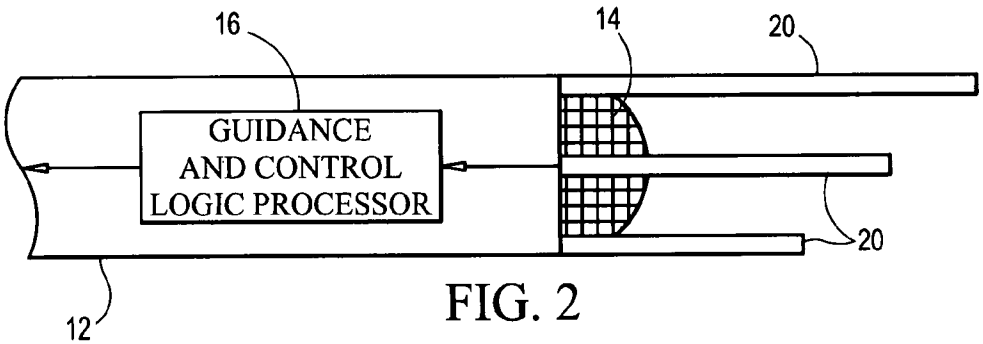
FIG. 2 is a side schematic view of the forward end of an unmanned underwater vehicle (UUV) outfitted with multiple ramming rods in accordance with another embodiment of the present invention.

The present invention is not limited to the embodiment described above. For example, the outboard end of rod 20 could have any of a variety of devices coupled thereto designed to enhance the damaging effects of rod 20 such as a non-lethal amount of explosive, a frangible container filled with an engine fouling agent where the container breaks open when struck by the targeted watercraft's propeller, etc. Another embodiment is illustrated in FIG. 2 where multiple rods 20 are fixedly coupled to the forward end of UUV 12. Each of rods 20 can be the same length or different lengths (as shown). When rods 20 have different lengths, UUV 12 could be operated to repeatedly drive into the targeted watercraft's propulsor as described above where each such strike causes the longest remaining rod 20 to inflict damage on the targeted watercraft's propulsion system.

Figure 3:
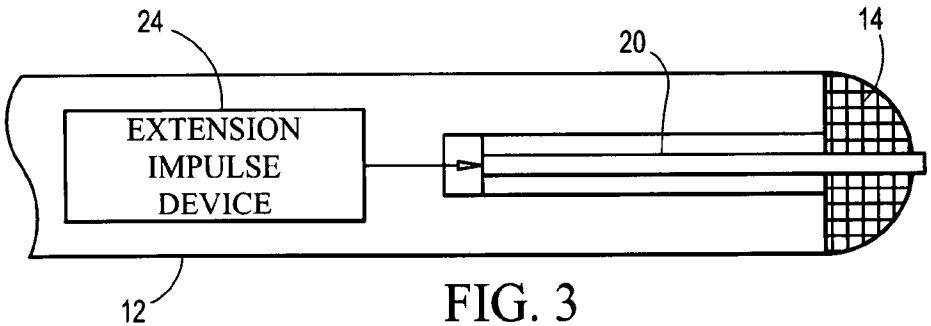
FIG. 3 is a side schematic view of the forward end of a UUV outfitted with an extendable ramming rod in accordance with another embodiment of the present invention.

Another possible embodiment of the present invention is illustrated in FIG. 3 where rod 20 is retracted within UUV 12 until UUV 12 is near the targeted watercraft. Once UUV 12 is positioned aft of a targeted watercraft, rod 20 is extended from UUV 12. An extension impulse device 24 can be provided onboard UUV 12 to extend and position rod 20 forward of UUV 12. Examples of device 24 could include gas driven piston mechanisms, mechanical piston mechanisms, electromechanical piston mechanisms, etc., the choice of which is not a limitation of the present invention.

Figure 4:
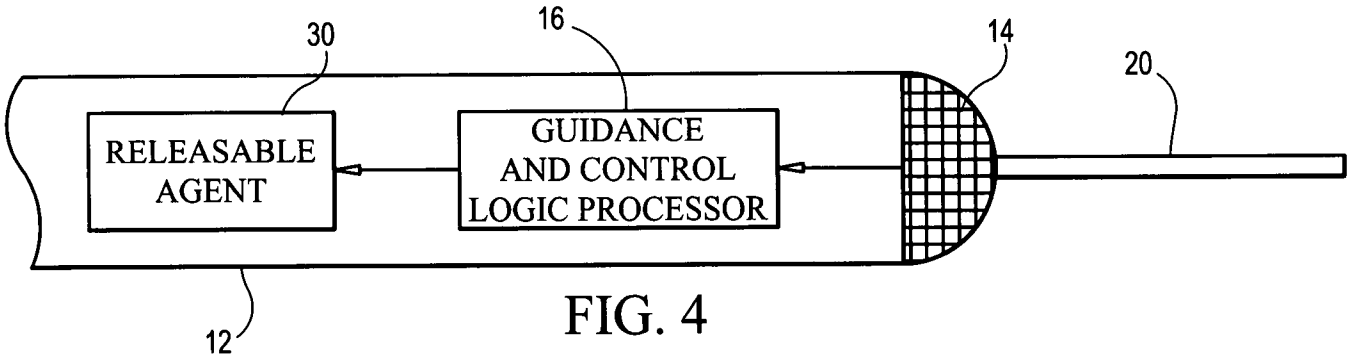
FIG. 4 is a side schematic view of the forward end of a UUV having a ramming rod and further equipped for the transportation and release of an agent into the water in accordance with another embodiment of the present invention.

The present invention could include additional non-lethal capabilities designed to further reduce or defeat the operational efficiency of a targeted watercraft's propulsion system. For example, UUV 12 in FIG. 4 stores a releasable substance or agent 30 onboard where release of agent 30 into a surrounding water environment is commenced once UUV 12 is near the targeted watercraft's propulsion system. In general, agent 30 is selected to negatively impact operational efficiency of the targeted watercraft's propulsion system. Accordingly, agent 30 could be a substance (e.g., a carbomer) that fouls a watercraft's propulsion system once ingested therein. Agent 30 could also be a substance that can be used to generate heat in the surrounding water environment. Such heat generation could result from a chemical reaction between the water and agent 30, or ignition of agent 30. Such heated water can be extremely detrimental to a watercraft's propulsion system if the heated water is ingested at the watercraft's cooling intakes. Expulsion of agent 30 from UUV 12 could be controlled by processor 16 while the means for generating an appropriate expulsion force are well known in the art.

Figure 5:
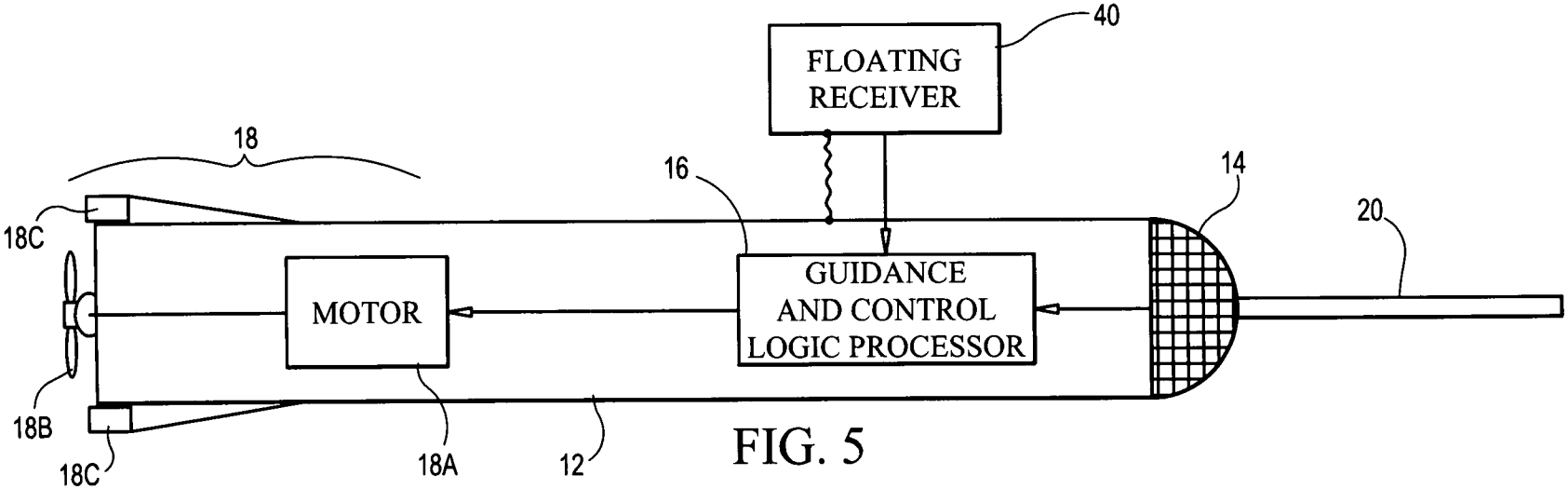
FIG. 5 is a side schematic view of a system in accordance with another embodiment of the present invention that is capable of receiving target tracking information from above the water's surface.

In the embodiments described thus far, UUV 12 tracks and homes in on a targeted watercraft using transducer array 14. As shown in FIG. 5, the present Invention's tracking and/or terminal guidance capabilities can be enhanced by collecting target track information from systems (not shown) operating above the water's surface. For example, an aircraft could track a targeted watercraft to establish its GPS location. This information could be used by UUV 12 to distinguish the targeted watercraft from others in the area as well as be used in the terminal guidance of UUV 12 when rod 20 is to be driven into the targeted watercraft's propulsor. To receive this information, UUV 12 can have a floating receiver 40 (e.g., an RF antenna) tethered thereto with the received signals being provided to processor 16 in order to properly guide UUV 12 to the targeted watercraft.

The advantages of the present invention are numerous. The system is non-lethal, stealthy, and can utilize readily-available UUV propulsion and guidance technology to keep up with any targeted watercraft. The system can be deployed from relatively long stand-off ranges and can be specifically directed to a particular watercraft. After use, the UUV can be retrieved and readily equipped for another operation.

Although the invention has been described relative to specific embodiments thereof, there are numerous variations and modifications that will be readily apparent to those skilled in the art in light of the above teachings. For example, the UUV's onboard control logic processor could store known acoustic signatures associated with a variety of watercraft wakes. The stored signatures could then be used for target verification during tracking. It is therefore to be understood that, within the scope of the appended claims, the invention may be practiced other than as specifically described.

What is claimed as new and desired to be secured by Letters Patent of the United States is:

1. A system for reducing the operational efficiency of a watercraft's propulsion system, comprising:

a self-propelled and variable-speed unmanned underwater vehicle (UUV), having an aft end with a propulsion system, said UUV including at least one homing device adapted to direct said UUV towards an origin of a targeted watercraft's propulsion wake; and at least one rod coupled to and retracted within a forward end, opposite the aft end, of said UUV, said rod being extendable from said UUV upon demand when said UUV is in proximity to the origin of the targeted watercraft's propulsion wake, wherein, the rod remains fixed to said UUV.

2. A system as in claim 1, wherein each said at least one rod is configured to break at a location therealong when a force is applied thereto.

3. A system as in claim 1, wherein said at least one rod is fixedly coupled to said forward end throughout underwater operation of said UUV.

4. A system as in claim 1, wherein said at least one homing device includes an acoustic homing device.

5. A system as in claim 1, further comprising a substance maintained onboard said UUV and releasable therefrom when said UUV is in proximity to the origin of the targeted watercraft's propulsion wake, said substance selected from the group consisting of engine fouling substances and heat energy producing substances.

6. A system as in claim 1, further comprising a floating device coupled to said UUV and adapted to receive information on the position of the targeted watercraft.

7. A system as in claim 6, wherein said floating device comprises an RF antenna.

8. A system for reducing the operational efficiency of a watercraft's propulsion system, comprising:

a self-propelled and variable-speed unmanned underwater vehicle (UUV), said UUV including an acoustic homing device adapted to direct said UUV towards an origin of a targeted watercraft's propulsion wake; and at least one rod coupled to and retracted within a forward end of said UUV and extendable upon demand from said UUV when said UUV is in proximity to the origin of the targeted watercraft's propulsion wake, each said rod incorporating a weakened region at a location along the length thereof and forward of said UUV wherein, when said UUV reaches the origin of the targeted watercraft's propulsion wake, said at least one rod is adapted to engage a portion of the watercraft's propulsion system wherein said at least one rod breaks at said weakened region thereof.

9. A system as in claim 8, wherein said at least one rod is fixedly coupled to said forward end throughout underwater operation of said UUV.

10. A system as in claim 8, further comprising a substance maintained onboard said UUV and releasable therefrom when said UUV is in proximity to the origin of the targeted watercraft's propulsion wake, said substance selected from the group consisting of engine fouling substances and heat energy producing substances.

11. A system as in claim 8, further comprising a floating device coupled to said UUV and adapted to receive information on the position of the targeted watercraft.

12. A system as in claim 11, wherein said floating device comprises an RF antenna.

13. A system for reducing the operational efficiency of a watercraft's propulsion system, comprising:

a self-propelled and variable-speed unmanned underwater vehicle (UUV), said UUV including an acoustic homing device adapted to direct said UUV towards an origin of a targeted watercraft's propulsion wake;

a floating RF antenna coupled to said UUV and adapted to receive information on the position of the targeted watercraft; and at least one rod coupled to and retracted within a forward end of said UUV and extendable upon demand from said UUV when said UUV is in proximity to the origin of the targeted watercraft's propulsion wake.

14. A system as in claim 13, wherein each said rod incorporates a weakened region along the length thereof, wherein each said rod breaks at said weakened region thereof when a force is applied thereto.

15. A system as in claim 13, wherein said at least one rod is fixedly coupled to said forward end throughout underwater operation of said UUV.

16. A system as in claim 14, further comprising a substance maintained onboard said UUV and releasable therefrom when said UUV is in proximity to the origin of the targeted watercraft's propulsion wake, said substance selected from the group consisting of engine fouling substances and heat energy producing substances.

17. A system as in claim 1, further comprising an extension impulse device onboard said UUV and configured to extend and position said at least one rod forward of said UUV.

* * * * *